US009487976B2

(12) United States Patent
Ala et al.

(10) Patent No.: US 9,487,976 B2
(45) Date of Patent: Nov. 8, 2016

(54) DOOR LOCKING DEVICE FOR AN ELECTRIC HOUSEHOLD APPLIANCE, IN PARTICULAR A DISHWASHER, AND ELECTRIC HOUSEHOLD APPLIANCE PROVIDED THEREWITH

(75) Inventors: Gianbattista Ala, Volpiano (IT); Pierluigi Carli, Turin (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 504 days.

(21) Appl. No.: 13/988,700

(22) PCT Filed: Nov. 25, 2011

(86) PCT No.: PCT/IB2011/055311

§ 371 (c)(1),
(2), (4) Date: May 21, 2013

(87) PCT Pub. No.: WO2012/070023

PCT Pub. Date: May 31, 2012

(65) Prior Publication Data

US 2013/0234578 A1 Sep. 12, 2013

(30) Foreign Application Priority Data

Nov. 26, 2010 (IT) ..... TO2010A0940

(51) Int. Cl.
*E05C 5/02* (2006.01)
*E05C 3/12* (2006.01)
(Continued)

(52) U.S. Cl.
CPC ..... *E05C 3/12* (2013.01); *A47L 15/4259* (2013.01); *E05B 15/0086* (2013.01); *E05C 5/02* (2013.01); *E05C 19/024* (2013.01); *Y10T 292/1052* (2015.04); *Y10T 292/1056* (2015.04)

(58) Field of Classification Search
CPC .... G06F 1/1658; G06F 1/187; G11B 33/124
USPC ..... 292/DIG. 21
See application file for complete search history.

(56) References Cited

U.S. PATENT DOCUMENTS 6,290,270 B1 9/2001 Spiessl
7,778,865 B1 * 8/2010 Kane ..... 705/7.42
(Continued)

FOREIGN PATENT DOCUMENTS

DE 20320530 U1 12/2004
DE 102004061231 B3 4/2006
(Continued)

OTHER PUBLICATIONS

International Search Report and Written Opinion corresponding to PCT/IB2011/055311, dated Feb. 3, 2012.
(Continued)

*Primary Examiner* — Kristina Fulton
*Assistant Examiner* — Thomas Neubauer
(74) *Attorney, Agent, or Firm* — Hauptman Ham, LLP

(57) ABSTRACT

A door locking device includes a supporting frame, a latch rotationally carried about a first axis by the supporting frame, a receiver for a locking tooth of the latch and first elastic element for rotating the latch between a first steady position in which, in use, with the door being closed, the tooth of the latch engages the receiver, and a second steady position, in which the tooth does not engage the receiver. The supporting frame is shaped to be fixed, in use, to one side of an access opening of the electric household appliance, integral with a casing of the latter; and the receiver has at least one seat carried, in use, by an edge of the door facing, in use, the side of the access opening provided with the supporting frame; moreover, the first axis is transversally movable with respect to itself, relatively to the supporting frame.

16 Claims, 9 Drawing Sheets

(51) Int. Cl.

| | |
|---|---|
| ***A47L 15/42*** | (2006.01) |
| ***E05B 15/00*** | (2006.01) |
| ***E05C 19/02*** | (2006.01) |

(56) References Cited

U.S. PATENT DOCUMENTS

| | | | | |
|---|---|---|---|---|
| 8,376,418 | B2 * | 2/2013 | Osvatic et al. | 292/216 |
| 8,733,802 | B2 * | 5/2014 | Promutico | D06F 7/28 292/113 |
| 2003/0218339 | A1 | 11/2003 | Bassi | |
| 2006/0012187 | A1 | 1/2006 | Adachi et al. | |
| 2007/0241568 | A1 | 10/2007 | Harrer | |
| 2007/0256715 | A1 * | 11/2007 | Oppel | A47L 15/4259 134/57 DL |
| 2008/0185849 | A1 * | 8/2008 | Hartmann | A47L 15/4259 292/60 |
| 2009/0064735 | A1 | 3/2009 | Hartmann et al. | |
| 2012/0126552 | A1 * | 5/2012 | Ala | E05C 19/024 292/228 |
| 2015/0267446 | A1 * | 9/2015 | Promutico, I | A47L 15/4259 292/122 |

FOREIGN PATENT DOCUMENTS

| | | | |
|---|---|---|---|
| DE | 102007033451 | A1 | 1/2009 |
| EP | 1304436 | A2 | 4/2003 |
| EP | 1344486 | A2 | 9/2003 |
| WO | 2006111501 | A1 | 10/2006 |
| WO | 2007140755 | A1 | 12/2007 |

OTHER PUBLICATIONS

Italian Search Report corresponding to IT TO20100940, dated Aug. 18, 2011.

* cited by examiner

DOOR LOCKING DEVICE FOR AN ELECTRIC HOUSEHOLD APPLIANCE, IN PARTICULAR A DISHWASHER, AND ELECTRIC HOUSEHOLD APPLIANCE PROVIDED THEREWITH

RELATED APPLICATIONS

The present application is a National Phase of International Application Number PCT/IB2011/055311, filed Nov. 25, 2011, and claims priority from Italian Application Number TO2010A000940, filed Nov. 26, 2010.

TECHNICAL FIELD

The present invention relates to a self-repositioning door locking device for an electric household appliance, in particular a dishwasher, as well as to the electric household appliance equipped with such a door locking device.

"Self-repositioning" means a door locking device which allows the user to close the dishwasher door also when, for whatever reason, the latch is already in the operating position corresponding to the that of locked door, and then to achieve the locking of the door in the closed position.

BACKGROUND ART

From EP1344486A a door locking device of high simplicity and small size is known, based on a rotating latch combined with an elastic flip-flop mechanism which makes the latch selectively take two different steady positions, consisting of a locked position in which, with the door being closed, the latch engages a hooking element, usually consisting of a U-shaped bracket, and an unlocked position in which the latch does not engage the hooking element, respectively. If, for whatever reason, with the door being open, the latch is in the locked position, the device must be manually rearmed by moving the latch to the unlocked position before closing the door.

From DE102007033451 a door locking device for a dishwasher is also known, in which the hooking device is carried by the frame of the electric household appliance and couples with a latch rotationally carried by a supporting body, in turn positionable in use on the door of the electric household appliance and in which, under certain conditions, transferring the hooking element to the rotating member is prevented. However, this is a rather complex and cumbersome device.

More generally, even when the known devices are completely satisfactory, they are designed to be mounted with their most cumbersome part in the thickness of the door of the electric household appliance; this prevents electric household appliances with thin doors from being manufactured, which would be highly useful, in particular in the field of dishwashers, in order to increase the inner receiving capacity of the electric household appliance. This latter problem is solved in part by the door locking device shown in WO2006/111501, which device, however, has a large bulk and a relatively high complexity.

DISCLOSURE OF INVENTION

It is one object of the present invention to provide a door locking device for an electric household appliance, in particular a dishwasher, which is easy to be manufactured, highly reliable, with a low cost and small size, and which allows electric household appliances with thin doors to be manufactured, while including a self-repositioning function of the latch which does not interfere with the normal operation of the device itself.

Therefore, the present invention relates to a door locking device for an electric household appliance, in particular a dishwasher, as defined in claim 1.

The door locking device of the invention comprises a supporting frame, a latch rotationally carried about a first axis by the supporting frame, receiving means for a locking tooth of the latch and first elastic means for rotating the latch between a first steady position in which, in use, the tooth of the latch engages the receiving means, with the door being closed, and a second steady position in which, with the door being closed, the tooth does not engage the receiving means.

The supporting frame is shaped to be fixed, in use, to one side of an access opening of the electric household appliance, integrally with a casing of the latter; the first axis is made so as to be transversally movable with respect to itself relatively to the supporting frame and is defined by a pair of opposite pins laterally protruding from the latch, which are slidingly engaged along first guides of an intermediate element carried by the supporting frame in a tilting manner, within the supporting frame itself, about a second axis parallel to the first axis and against the bias of second elastic means. The opposite pins of the latch pass through the first guides and also slidingly engage, simultaneously to the first guides, second guides directly obtained on the supporting frame, parallel to the first guides and ending on the side of the second axis with respective L-shaped recesses facing the opposite side of the latch tooth, so that the first axis is relatively movable with respect to the second axis in the common extension direction of the first and second guides.

Finally, the invention relates to an electric household appliance equipped with such a door locking device, according to claim 12.

In this manner, i.e. fitting the door locking device practically upside down on the electric household appliance, as compared to commonly known devices, the most cumbersome part of the device is moved from the door to the casing of the electric household appliance where it may be easily accommodated without any additional bulk inside the casing, in the usually U-shaped front crosspiece having the concavity facing upwards, however present for structural reasons. Therefore, electric household appliances may be made with much thinner doors, to the advantage of the inner space available, which is particularly useful in the case of dishwashers where a thinner door allows a much deeper top rack to be made for receiving dishes, thus increasing the useful load of the machine. Moreover, the most mechanically complex part of the door locking device may be easily accessed for possible maintenance interventions, because just the top (upper buffering panel) of the casing needs to be removed to reveal the concave part of the front crosspiece which accommodates the supporting frame.

However, in order to reduce such an innovation into practice, making certain modifications to the devices of the known art was required. According to one embodiment the traditional U-shaped bracket, used as a receiving element of the latch tooth, has been replaced with a concave seat. The latch has been slidingly mounted with respect to the supporting frame, this innovation not only providing a more reliable operation of the door locking device but also ensuring that, with the door being closed, the latter exerts such a bias on the door itself to increase the pressure normally exerted by the door on the peripheral sealing gasket of the access opening, thus improving the sealing itself, but without increasing the resistance provided by the elastic means of the door locking device during the step of closing. Finally, using an intermediate tilting element interposed between the latch and the supporting frame allows the device to be made self-repositioning because, if the latch is in the first steady position, with the door being open, the push exerted by the door during the closing step directly on the locking tooth of the latch pushes the latter to the stroke end in the first guides and the intermediate element to rotate on the second axis, which is allowed by the presence of the L-shaped recesses in the end part of the second guides, thus allowing the tooth of the latch to be lifted and "jump" the door edge, to then snap into the receiving means integral with the door.

BRIEF DESCRIPTION OF THE DRAWINGS

Further features and advantages of the present invention will become apparent from the description of a preferred embodiment thereof, provided below by way of mere non-limiting example and with reference to the accompanying drawings, in which.

BEST MODE FOR CARRYING OUT THE INVENTION

Figure 1:
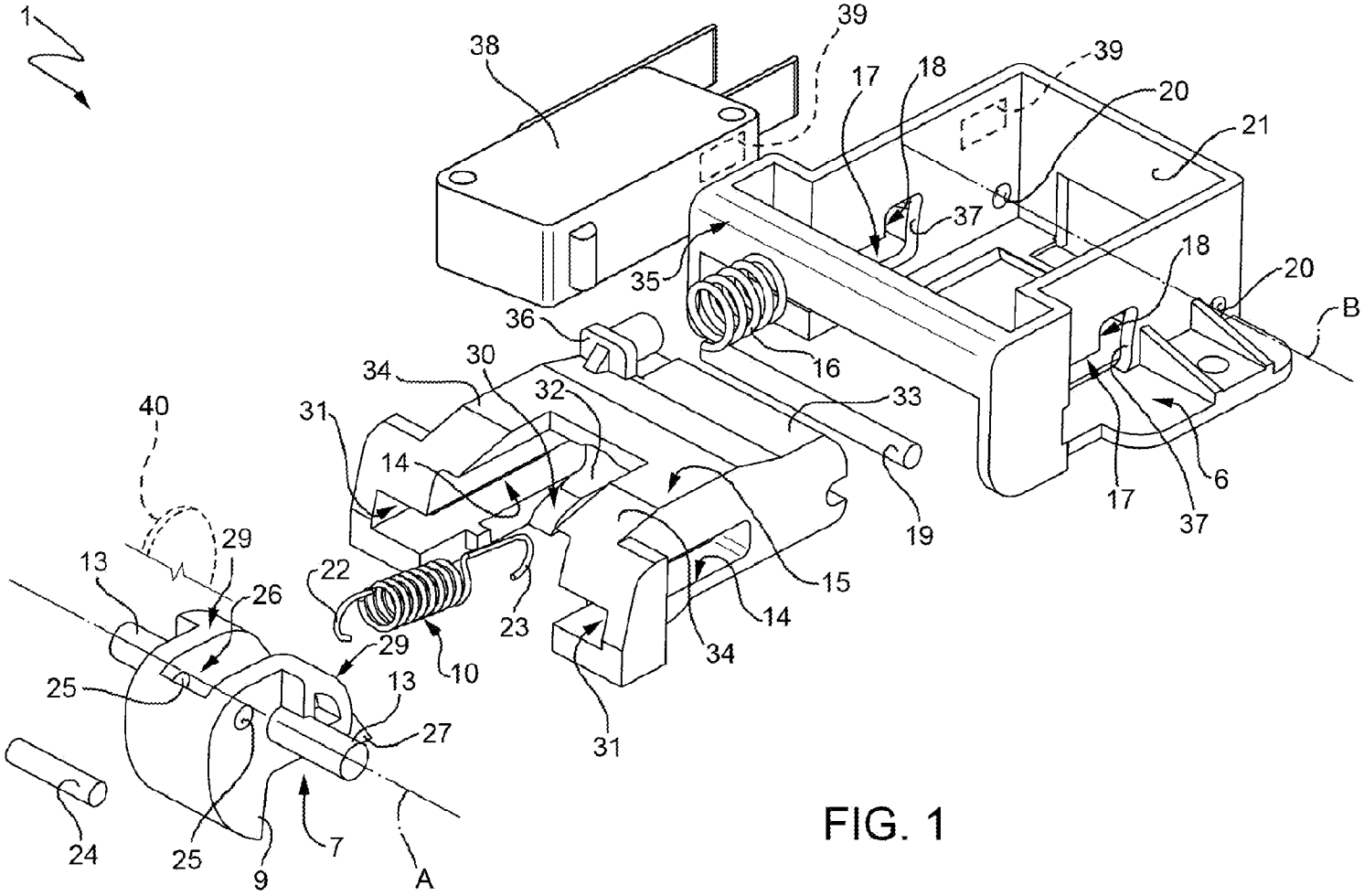
FIG. 1 diagrammatically shows a three-quarter front perspective view, in an exploded configuration, of a door locking device for an electric household appliance provided according to the invention.

With reference to FIGS. 1 to 6 and 12, numeral 1 indicates as a whole a self-repositionable door locking device (represented in black-box format by element 1033 in FIG. 12) for an electric household appliance 2 (represented in black-box format by element 1031 in FIG. 12), in particular a dishwasher, in which only part of the top front portion of a casing 3 is shown for simplicity, as well as a top edge of a closing door 4 of an access opening 5, typically of a washing chamber or tank (element 1032 of FIG. 12), delimited by casing 3.

Although the following non-limiting description refers to the case of a dishwasher, it is evident that the door locking device according to the invention may be applied both to doors with horizontal rotation axis, as in the case of dishwashers, and to doors with vertical rotation axis, such as for example when the door consists of the porthole of a front-loading washing machine. Moreover, with minimal adaptations, the device 1 which will be described may also be employed for oven doors.

Figure 2:
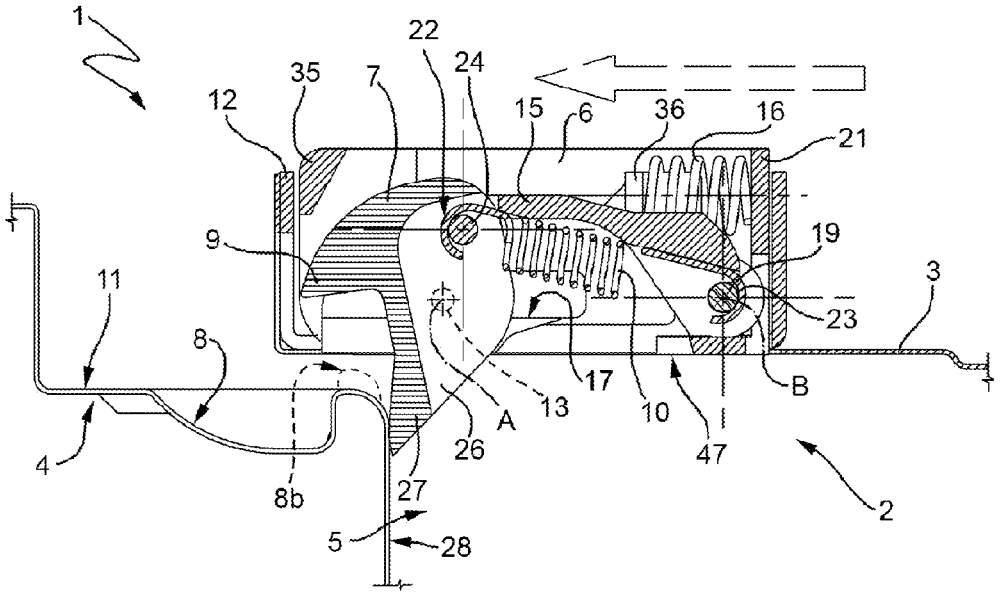
FIGS. 2 to 5 diagrammatically show the same side view, in elevation and longitudinally cut-out, of the device in FIG. 1 during the steps of closing and opening door.
Figure 3:
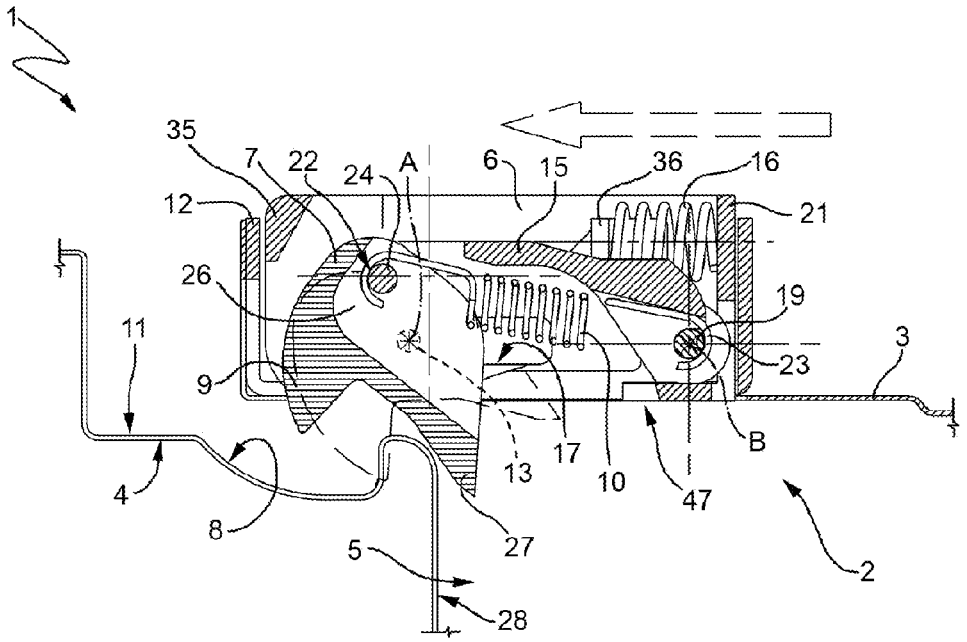
Figure 4:
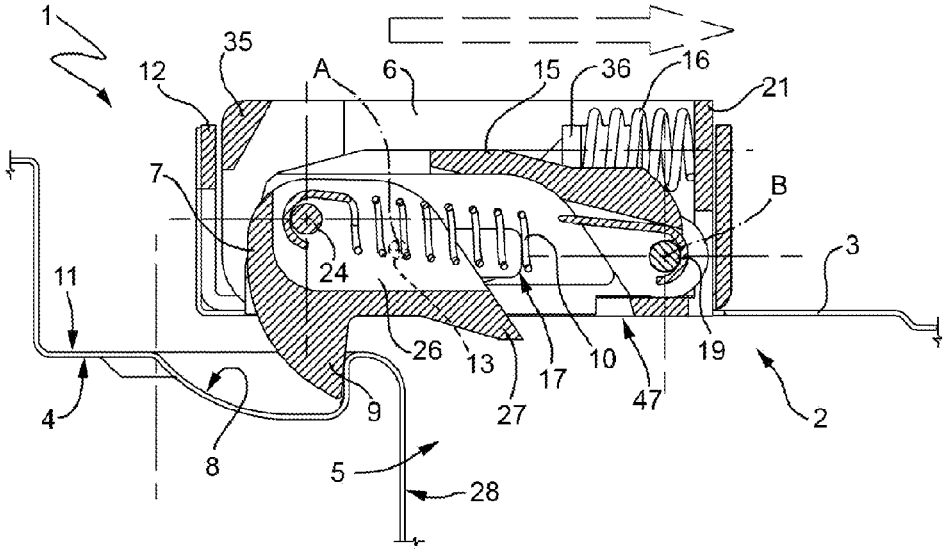
Figure 5:
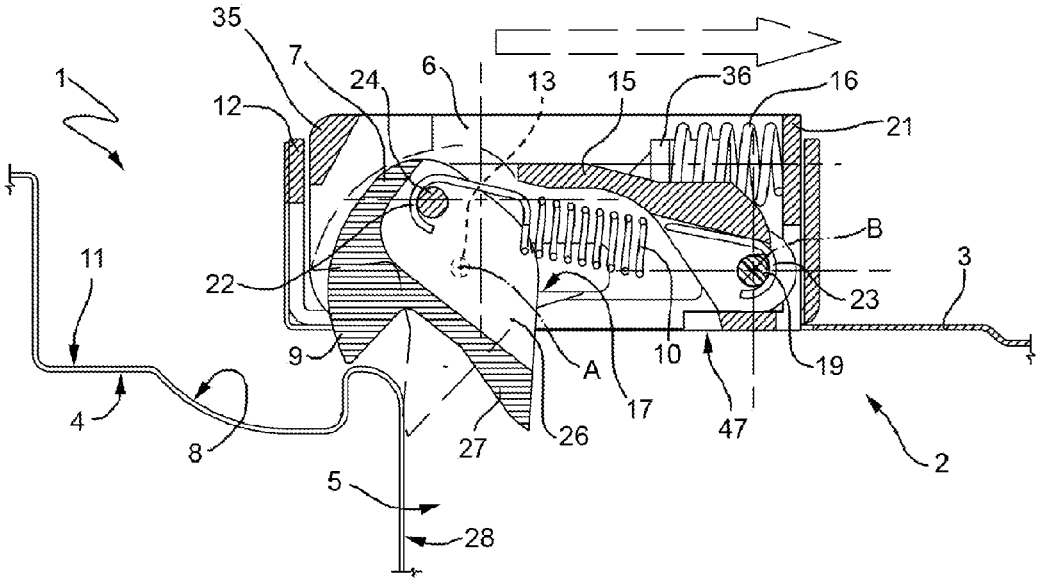
Figure 6:
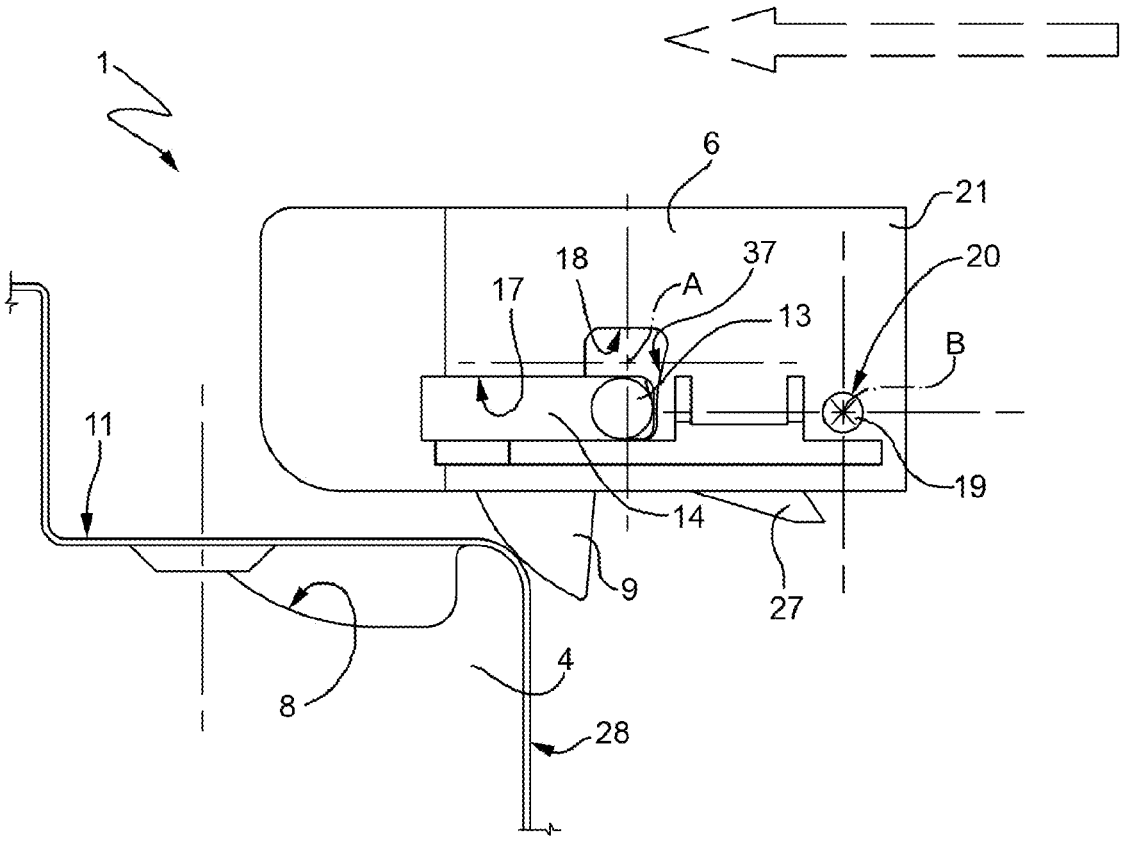
FIG. 6 diagrammatically shows the same elevation side view in FIGS. 2-4, not cut-out, of the device of the invention during the step of repositioning the latch.

With particular reference to FIG. 1, device 1 comprises a supporting frame 6, a latch 7 rotationally carried about a first axis A by the supporting frame 6, receiving means 8 (FIGS. 2-5) for a locking tooth 9 of the latch and first elastic means 10 for rotating latch 7 between a first steady position, shown in FIGS. 1, 4 and 6, and a second steady position, shown in FIG. 2.

In use, in the first steady position of latch 7, with the door 4 being closed (FIG. 4), tooth 9 engages the receiving means 8, while in the second steady position, tooth 9 does not engage the receiving means 8, as it is rotated far therefrom (FIG. 2).

According to an aspect of the invention, the supporting frame 6 is shaped to be fixed, in use, to one side of the access opening 5 of the electric household appliance 2, integrally with casing 3 of the latter; in combination, the receiving means 8 are carried by door 4 and, in the illustrated embodiment, consist of a concave seat carried, in use, by an edge 11 of door 4 facing in use the side of the access opening 5 provided with the supporting frame 6, in the non-limiting example disclosed consisting of a front, top U-shaped cross-piece 12 of casing 3, having the concavity facing upwards and hence, in use, towards a top or upper buffer surface of the electric household appliance 2, known and not shown for simplicity.

The concavity or seat 8 may be directly obtained in one piece with door 4, by plastic deformation of a section of edge 11, or as it will be seen, it may be obtained on one element mountable on door 4; if a deep seat 8 or a large tooth 9 enough to ensure a firm gripping of door 4 may not be provided, the receiving means 8 may also include a tooth **8*b* (FIG. 2) obtained so as to overhangingly protrude from edge 11 in correspondence with the concave seat 8**.

According to another non-secondary aspect of the invention, axis A is also provided so as to be transversally movable with respect to itself relatively to the supporting frame 6.

This feature is obtained due to the first axis A being defined by a pair of opposite cylindrical pins 13 laterally protruding from latch 7, which are slidingly engaged along first guides 14 of an intermediate element carried by the supporting frame 6 in a tilting manner, within the frame 6 itself. In particular, as it will be better seen below, the intermediate element 15 which is shaped like a U-shaped frame, may rotate with respect to frame 6 about a second axis B parallel to axis A and against the bias of second elastic means 16.

The opposite pins 13 pass through the guides 14 and slidingly engage, simultaneously to the first guides 14, also second guides 17 directly obtained on the supporting frame 6, parallel to guides 14 and ending on the side of the second axis B with respective L-shaped recesses 18 facing the opposite side of the tooth 9 of latch 7; in this case, axis B is defined by a pin 19 transversally mounted through frame 6, integral with the latter, because it is thoroughly inserted into a pair of side holes 20, coaxial to each other, obtained through respective side walls of frame 6, at one end 21 of frame 6 which, in use, is arranged so as to be oriented to the opposite side of door 4 and which thus represents the end of frame 6, in use arranged so as to be distal from the door 4 of the electric household appliance 2.

Thereby, the first axis A defined by pins 13 slidingly engaged in the guides 14 and 17 (or defined by any one other structural element of latch 7 having an equivalent function) is carried in use by frame 6, so as to be relatively movable in the extension direction of guides 14, 17, with respect to the axis B defined by pin 19 engaged in the holes 20.

The first elastic means consist of at least one preloaded helical spring 10, tensioned restrained, at the opposite ends 22, 23 thereof, on one side to the supporting frame 6 at axis B, and on the opposite side to a restraining point integral with latch 7 and arranged eccentrically to axis A; in the embodiment shown, the helical spring 10 ends with opposite hook-shaped ends 22, 23, which are coupled to the pin 19 (end 23) inserted into the holes 20 to form the axis B integral with frame 6, and to a second pin 24 (end 22) parallel to pin 19 and to pins 13 carried by latch 7, respectively.

Pin 24 forms the aforesaid restraining point for spring 10, arranged eccentrically to axis A. In particular, pin 24 is arranged so as to be parallel to axis A and is positioned eccentrically with respect to axis A, on the opposite side, with reference to the position of axis A, to a direction along which tooth 9 overhangingly extends from latch 7.

In practice, pin 24 is inserted through a pair of side holes 25 of latch 7 thoroughly obtained parallel to pins 13 at the base of tooth 9, but laterally displaced with respect to pins 13, while tooth 9 overhangingly extends from latch 7 on the opposite side, with reference to the position of pins 13, with respect to that occupied by the holes 25; furthermore, in order to allow the end 22 of spring 10 to be accommodated, pin 24 is mounted so as to transversally pass through a recess or vane 26 of latch 7 open towards the end 21 of frame 6.

According to another aspect of the invention, latch 7 is also integrally provided with a radial appendix or arm 27 overhangingly protruding from latch 7 and extending, with respect to axis A, from the same side of the locking tooth 9, but in a direction diverging from the latter; the appendix or arm 27 is shaped so as to be adapted, in use, to cooperate in contact with an inner face 28 of the door 4 of the electric household appliance 2 and/or with the outer profile (as facing the side opposite to seat 8) of tooth 8*b* to urge the rotation of latch 7 against the bias of the elastic means 10, from the second steady position in FIG. 2 towards the first steady position in FIG. 4 during the step of closing door 4.

According to a further aspect of the invention, when carrying out the rotation between first and second steady positions about axis A, latch 7 is guided by first cam means 29 (FIG. 1) obtained on both the opposite sides of latch 7, radially protruding from the pins 13; the cam means 29 are indeed adapted to cooperate, during such a rotation, with second cam means 30, integrally obtained with the intermediate element 15, laterally inside the same with respect to guide 14, on the side opposite to a frontal inlet opening 31 of guides 24, designed to thoroughly receive the pins 13 in order to allow them to be introduced into guides 14 and 17, in the step of assembling the device 1.

In practice, the first cam means 29 are defined by respective cylindrical sectors having an angular width substantially equal to a square angle, having a curved surface which is concentric with axis A and obtained in one piece with latch 7 (which is preferably obtained by moulding a synthetic plastic resin) in a position diametrically opposite to the locking tooth 9; while the second cam means 30 consist of respective inclined planes having a curved surface (only one of which being visible in FIG. 1) frontally obtained on respective ridges 32 inside the element 15 arrange adjacent to guides 14 on the inner side thereof.

As already mentioned, the intermediate element 15 is shaped like a U-shaped frame, substantially rectangular in plan, and consists of a crosspiece 33 (FIG. 1), which is arranged towards the end 21 of the supporting frame 6, to which the crosspiece 33 is rotationally restrained about axis B, and of two arms 34 parallel to each other and which overhangingly project from crosspiece 33 towards a second open end 35 of frame 6, opposite to the first end 21.

Guides 14 consist of through side grooves or slits of the arms 34, frontally open towards the end 35; similarly, the guides 17 also consist of through side grooves or slits obtained through the side flanks of frame 6; the terminal L-shaped recesses 18 form an integral part of such grooves/slits and have such dimensions to be adapted to receive, in use, the pins 13 when they are substantially at the end of stroke position in the guides 14 (FIG. 6) to allow, when needed, the rotation of the intermediate element 15.

For this purpose, the elastic means 16 are interposed between the end 21 of frame 6 and an L-shaped appendix or rib 36 of the intermediate element 15, which overhangingly protrudes from crosspiece 33, in the same direction along which the terminal L-shaped recesses 18 extend; the latter are then delimited on the side of end 21 by respective curved edges 37 having their curvature center on axis B and defining third cam means for guiding, in use, the rotation of the intermediate element 15 with respect to the supporting frame 6 about axis B. The wing of the L-shaped recesses 18 which extends towards rib 36 is sufficiently long to completely accommodate the pins 13 so that, as it will be seen below and as shown in FIG. 6, axis A may be lifted above the guides 17 to allow element 15, to which axis A is restrained due to the its engagement in slits 14, to rotate about axis B.

Finally, device 1 comprises a micro switch 38 of known type, arranged by the side of frame 6, to which it is restrained by means of complementary snap connecting means 39, which are known and diagrammatically indicated with a broken line as simple blocks, cooperating with a cam element 40 obtained in one piece with latch 7 so as to be operated by latch 7 when, with the door 4 being closed, the latter is in the first steady position in FIG. 4; in particular, the cam element 40 (only diagrammatically shown with a broken line) may be obtained in one piece with the end of pin 13 facing the side of the micro switch 38, which end laterally protrudes from frame 6 through the corresponding guiding slit 17; the micro switch 38 is only operated in the position of latch 7 in FIG. 4, because axis A translates, in use, along the guides 17 while latch 7 goes from the position in FIG. 4 to that in FIG. 2 and vice versa.

Figure 7:
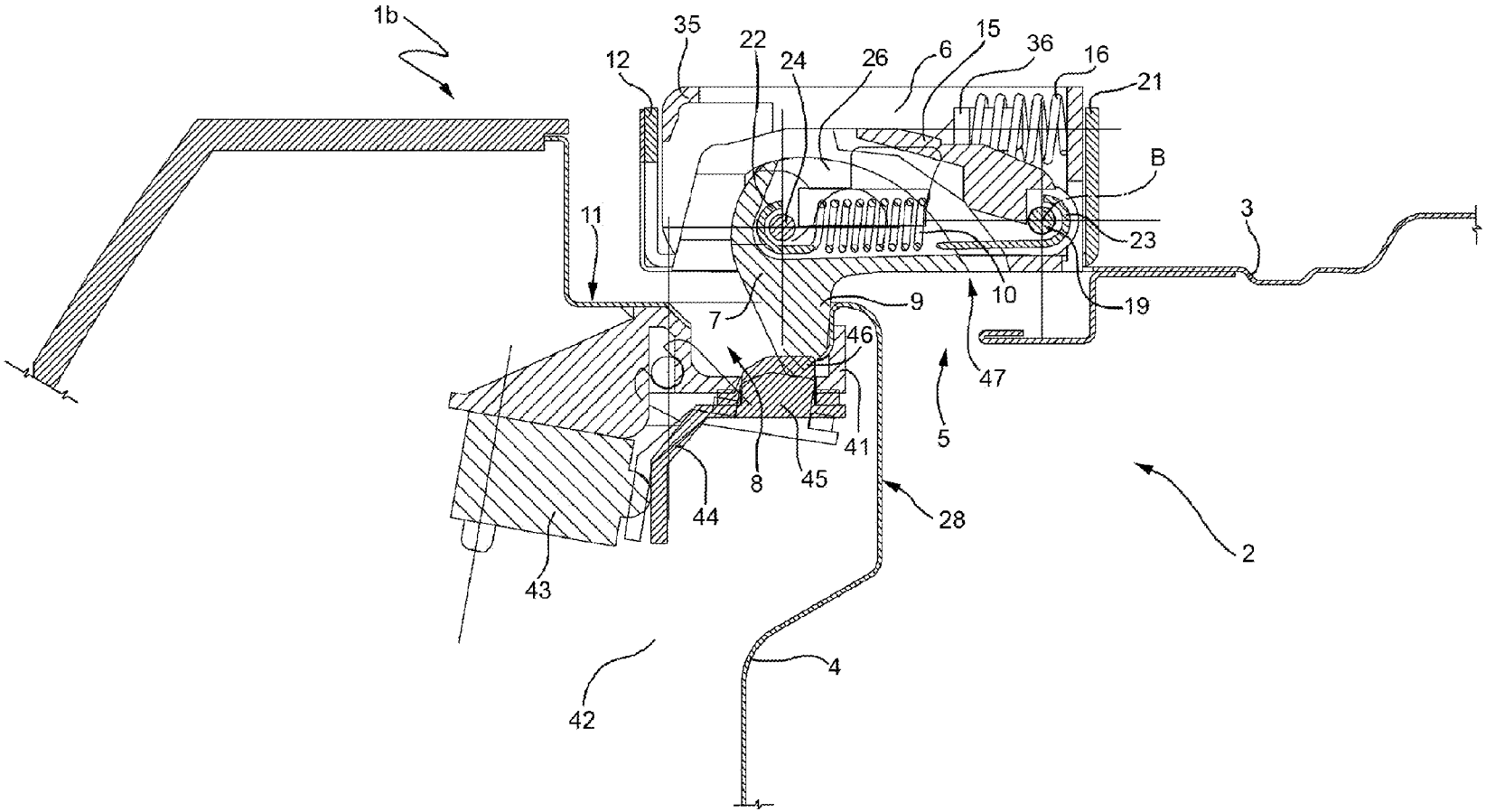
FIG. 7 shows a detail of a possible variant of the device in FIG. 1.

Now, with reference to FIG. 7 where similar or equal details to those already described are indicated for simplicity with the same numerals, a variant 1*b* of device 1 is shown, which is identical to the device 1 described, except that it also comprises a plate-like element 41 suitable for being integrally fixed, in use, to the edge 11 of door 4; the plate-like element 41 carries seat 8 (and the possible tooth 8*b*, if required) from the side facing, in use, the casing 3 of the electric household appliance 2, which seat thus is no longer obtained in one piece with door 4. Moreover, alternatively to using the micro switch 38 integrally carried by frame 6, the plate-like element 41 may carry a micro switch 43 of known type on the side opposite to that provided with seat 8, intended in use to face an inner cavity 42 of door 4, which micro switch is operated by an L-shaped tilting lever 44, a first end of which is provided with a button 46 which overhangingly protrudes into seat 8, through a window of the plate-like element, to cooperate in use with the locking tooth 9 of latch 7 when, with the door being closed, the latter is in the steady closed position, shown in FIG. 7.

According to the invention, an electric household appliance 2 forms part of the same inventive concept, comprising a casing 3 delimiting the access opening 5 to a washing chamber or tank and a door 4 for closing the opening 5; in which opening 5 is delimited at the top by a U-shaped crosspiece 12 which forms a structural part of casing 3 and has its own concavity facing the opposite side of the top edge 11 of door 4; and in which a device 1 or 1*b* as previously described has the frame 6 with latch 7 accommodated within the crosspiece 12, in a position facing an opening 47 of crosspiece 12 adapted to thoroughly receive the locking tooth 9; and finally, in which seat 8 (with the possible tooth 8*b*) forming the receiving means 8 of the locking tooth 9 is carried by a plate-like element 41 fixed to the top edge 11 of door 4 in a position facing the opening 47 of crosspiece 12, with the door 4 being closed.

The operation of the device 1 (or 1*b*) described is apparent.

With the door 4 being open, i.e. far from the access opening 5, latch 7 normally is in the position in FIG. 2, which is a steady position, as the preloaded spring 10 is opposed by the engagement of pins 13 in the guides 14 and 17, because axis A is arranged closer to door 4 than to pin 24.

When door 4 is neared to opening 5 to bring it to the closed position, face 28 intercepts arm 27 while pushing on latch 7; due to the cooperation between the cam means 29 and 30, this may not simply move back along the guides 14, 17 but is forced to rotate about axis A; therefore, tooth 9 nears the receiving means 8 (FIG. 3) while axis A, by means of pins 13, slides along the guides 17 moving towards end 21, until pin 24 is closer to door 4 as compared to the pins 13. In such a position, spring 10 which in the meantime has been stretched by being loaded with elastic energy, completes the rotation of latch 7 up to reaching the position in FIG. 4, which is a steady position again, as pins 13 reached the end of stroke position and the operating axis of spring 10 now passes though axis A, thus without exerting any torque on latch 7. In such a position, spring 10 exerts a pulling action on latch 7 which transmits it to door 4 by pushing it against the peripheral gasket (known and not shown) which runs along the access opening 5.

In order to open the door 4, exerting a traction (FIG. 5) thereon is enough so as to move it away from the opening 5; such a traction is transmitted to tooth 9, while moving latch 7 towards end 35 against the initial resistance bias of spring 10: latch 7 simultaneously rotates backwards, while pins 13 slide in the guides 14 and 17 towards the end 35, aided in such movements by spring 10, which elastically recovers the stretching out previously sustained, as soon as its biasing axis upon the corresponding movement of pins 13 and 24, reacquires a lever arm with respect to axis A, thus exerting a return torque on latch 7.

If, for any reasons, latch 7 is in the locked position in FIG. 4, but with the door 4 being open (FIG. 6), by closing door 4, the face 28 hits tooth 9 thus pushing latch 7 towards the end of stroke position up to bringing the pins 13 at the recesses 18; by shaping the front part of tooth 7 facing in use towards door 4 as a curved surface, the door 4 also pushes tooth 9 upwards; in the position shown of pins 13, such a push generates the rotation of element 15 about axis B, against the bias of spring 16, because the pins 13 may slide into the recesses 18 up to being above the guides 17; tooth 9 may thus "jump" edge 11 to then regularly engage the receiving means 8 by means of the elastic recovery bias of spring 16. The door lock 1 has thus been correctly repositioned without any intervention by the user.

With reference now to figures from 8 to 11, they show a door locking device 100 which is a different embodiment of the devices 1/1*b* previously described; details similar or identical to those as already described are indicated with the same reference numbers for sake of simplicity.

Device 100, which operates exactly as device 1 previously described, differs from device 1 in that receiving means 8 are replaced by receiving means 8*c* and in that elastic means 16 are replaced by elastic means 16*b* and 16*c*.

In particular, the household appliance door 4 is provided with receiving means 8*c* on edge 11; receiving means 8*c* consist in a plate-like element 41*b* provided with a projection 410 adapted to be inserted in use through a suitable through opening provided in edge 11, and with an opposite ogive-shaped projection 412, which projects in cantilever fashion from plate-like element 41*b* towards casing 3 and the respective support frame 6. Latch 7 is, according this embodiment, fork shaped and comprises, other than tooth 9, an opposite tooth 27*b* with replaces arm 27 and which extends in parallel to tooth 9 in such a manner to define, between teeth 9 and 27*b*, a recess 101 adapted to engage in use upon projection 412 to restrain plate-like element 41*b* to support frame 6 and consequently locking door 4 against casing 3 to close the access opening 5.

Moreover, the single spring 16 is replaced by a pair of helical springs 16*b* superiorly carried by arms 34 perpendicularly to axes A and B and by a second pair of springs 16*c*, placed at 90° orientation with respect to springs 16*b*. These latter are pack-tight assembled between the intermediate, frame-shaped element 15 and a cover 102 attached on support frame 6, above the same, for covering and protection of the intermediate element 15; springs 16*b* are spaced apart from axis B and have the purpose to contrast the rotational movement of intermediate element 15 around axis B; springs 16*c* are, on the contrary, pack-tight assembled between end 35 and cross-bar 33 for opposing in use the possible relative translation between element 15 and frame 6.

Figure 8:
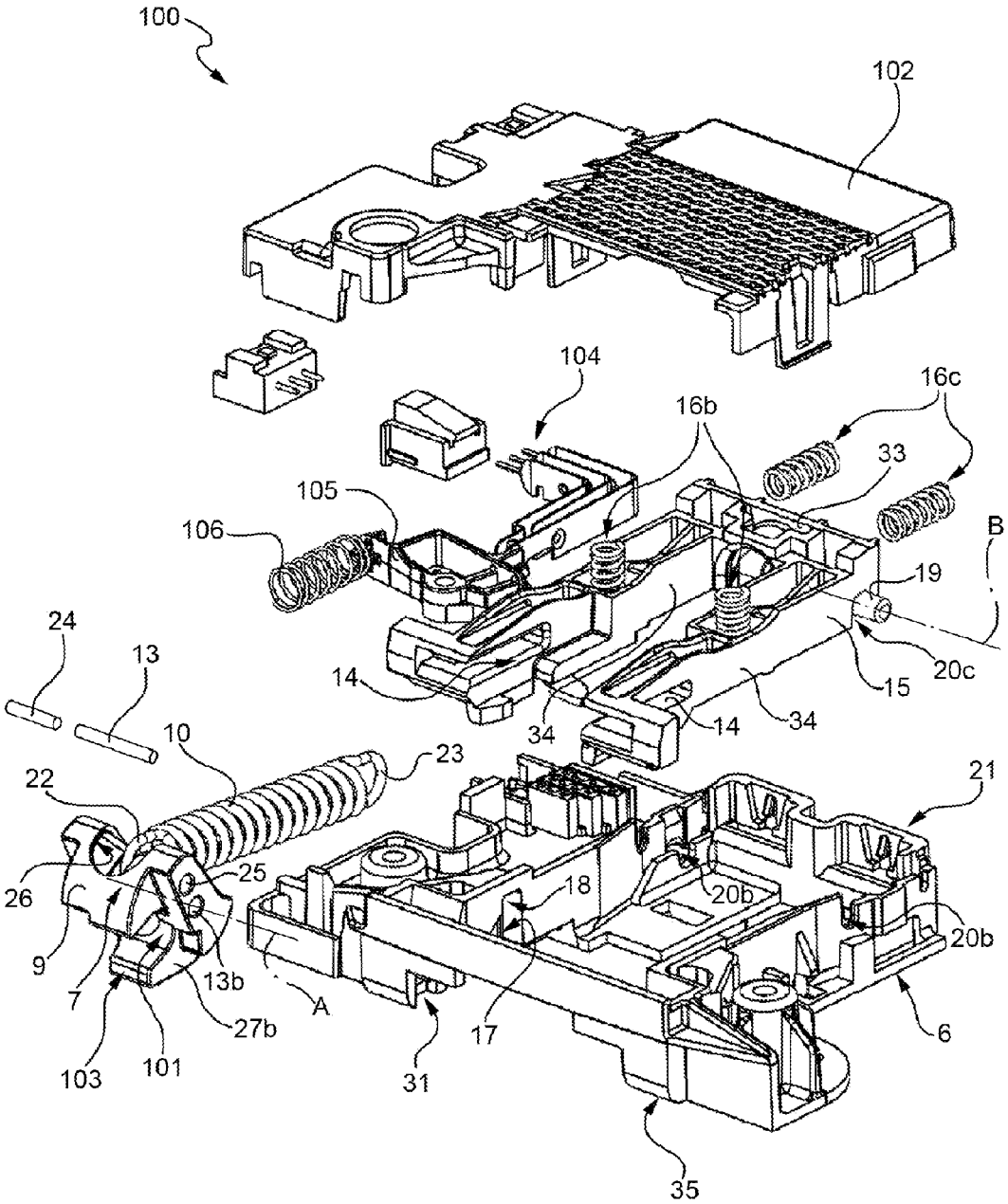
FIG. 8 shows schematically a three-quarter front perspective, exploded view of a second embodiment of the household appliance door locking device according to the invention.

Pin 19 embodying axis B is in fact mounted within saddle-shaped seats 20*b* of frame 6 and it is pass-through mounted with play through recesses 20*c* of the intermediate element 15. Tooth 27*b* ends with a flat-plane, shoulder surface 103, which has the purpose to cooperate in use with door 4 when latch 7 is in the second working position (FIG. 8), during the closure step of door 4, so as to urge latch 7 to rotate against the bias of spring 10 towards the first working position, just as described before for device 1. Spring 10, however, it is not restrained between pin 24 and pin 19, as previously described, but it is restrained between pin 24 and end 21 of support 6.

Figure 9:
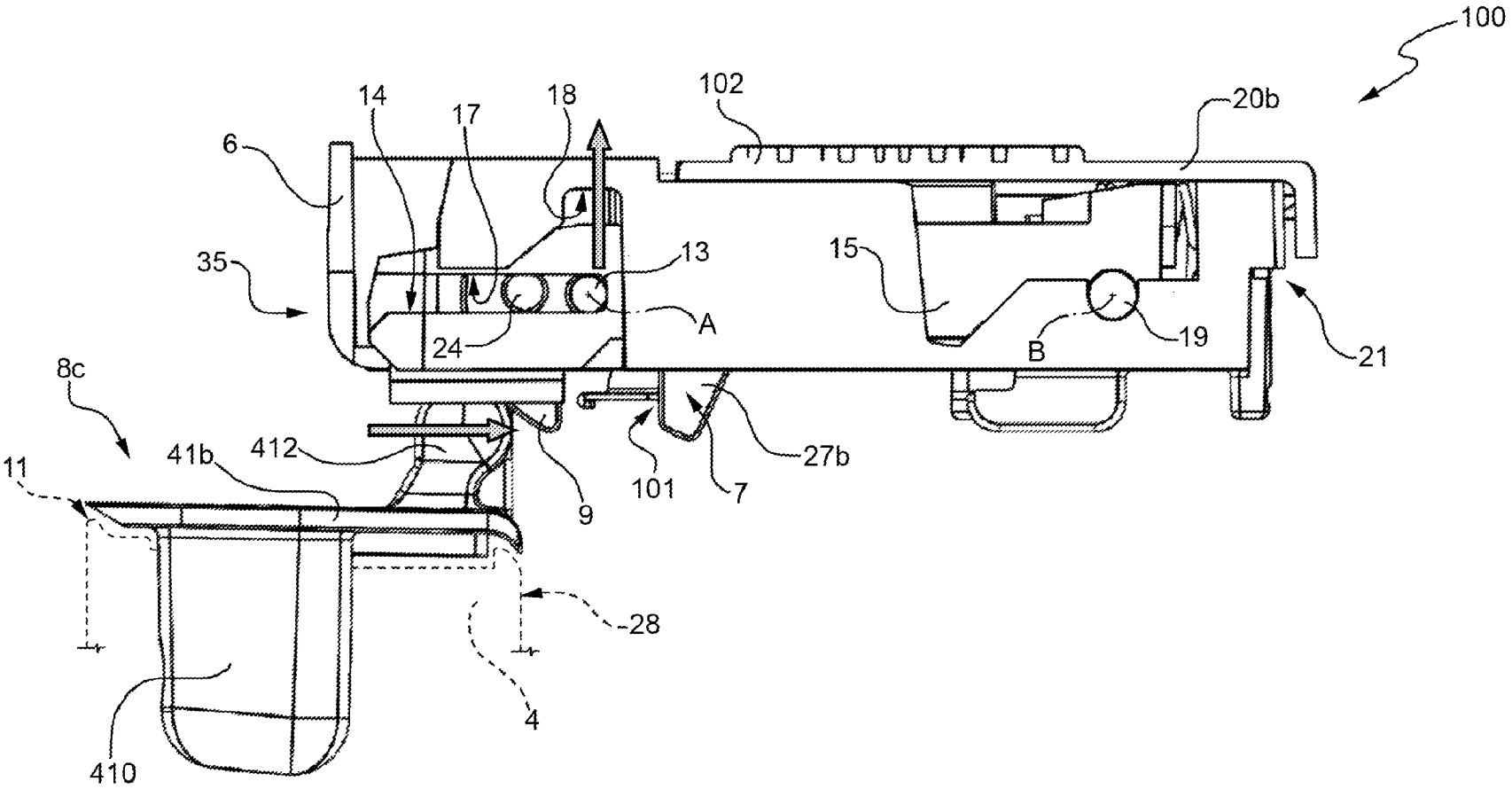
FIG. 9 shows an elevation lateral view of the device of FIG. 8 during the step of repositioning the latch.
Figure 10:
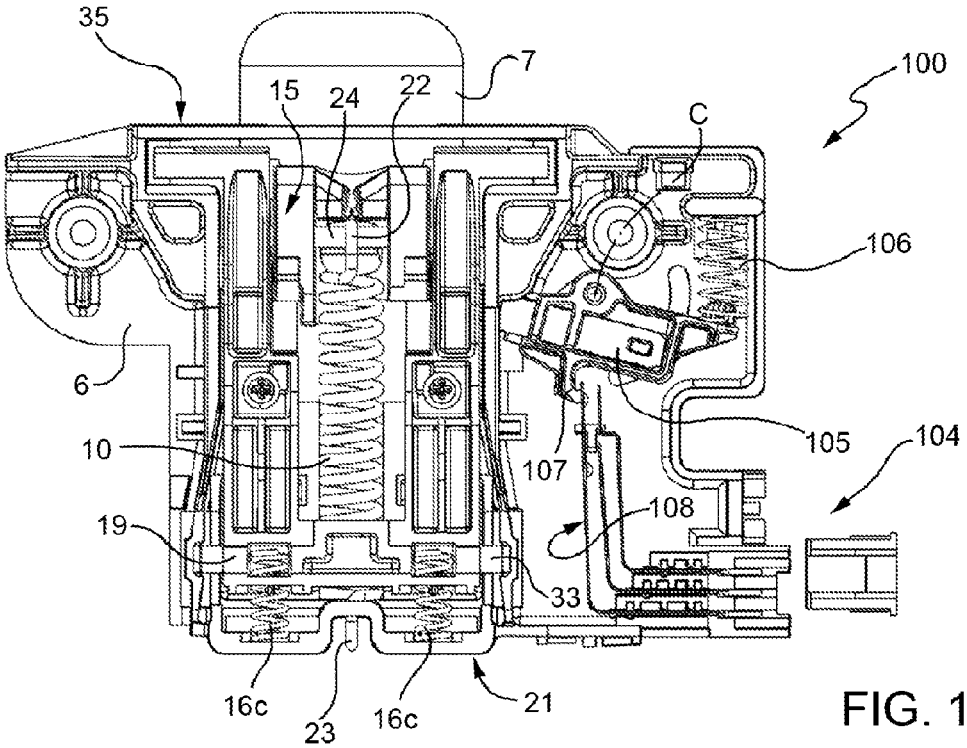
FIGS. 10 and 11 show two top plan view of the device of FIG. 8, FIG. 11 with parts removed for a better comprehension.

In case the latch remains (or is brought by accident) in the second position when door 4 is open, projection 412, during the closing stroke of door 4, goes to hit against tooth 9 (FIG. 9) forcing latch 7 to travel along guides 14 and 17 by sliding within them by means of one single pin 13 mounted in a through manner within transversal holes 13*b* of latch 7; when latch 7 reaches its end of stroke position within guides 14, the intermediate element 15 is urged, against the action of springs 16*c*, up to bring pin 13 to reach its end of stroke position within guides 17, in correspondence with L-shaped recesses 18; the reaction exerted by pin 19 allows element 15 to rotate accordingly around axis B and against the action of springs 16*b* bringing pin 13 within recesses 18; in this manner, latch 7 "jumps" over projection 412 and crosses it, to then going into engagement with projection 412 by means of recess 101 due to the elastic reaction of springs 16*b*. Door 4 is consequently locked, because device 100, like device 1, operates, according to what described, in a self-repositioning manner.

A further difference between device 100 and device consists in that micro-switch 38 is replaced by a micro-switch 104 fully integrated within device 100.

Figure 11:
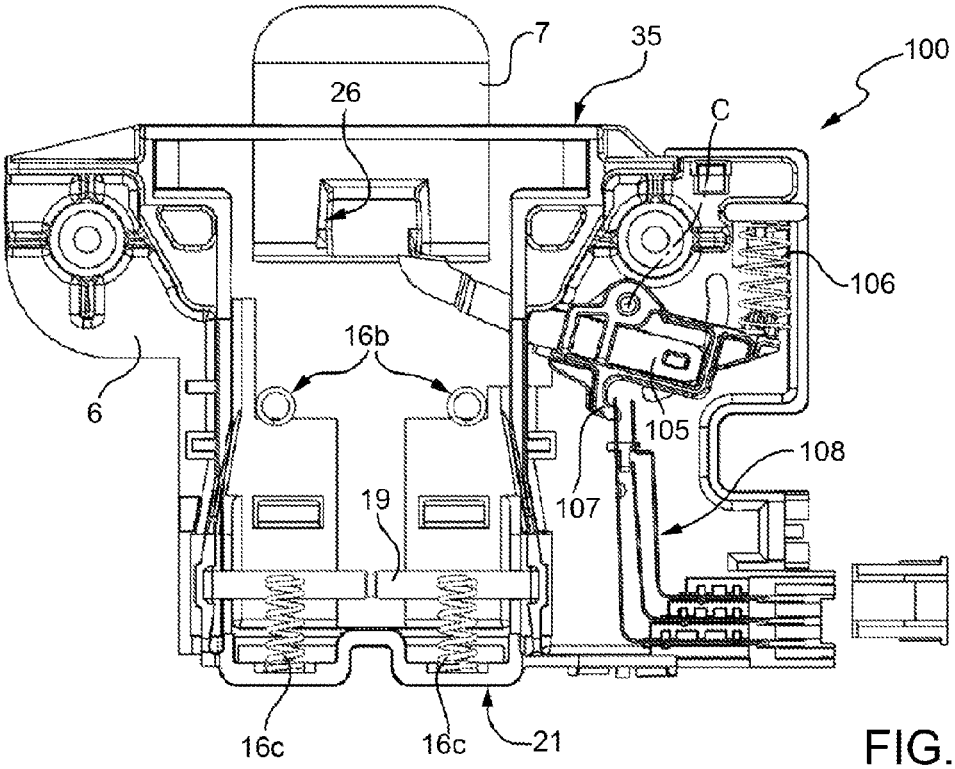
Figure 12:
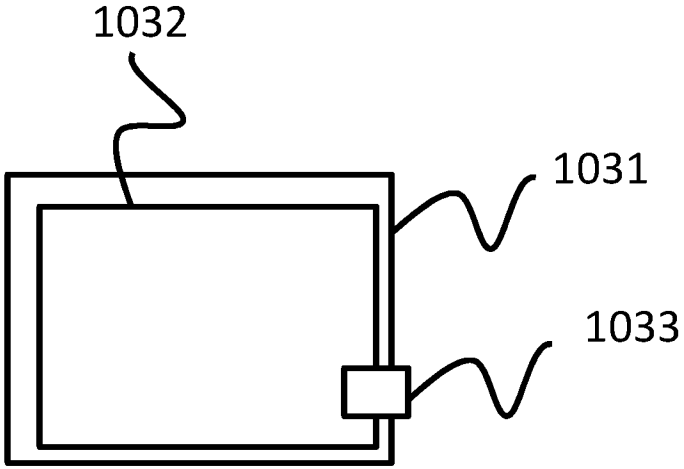
FIG. 12 shows a black-box electric household appliance.

Switch 104 comprises a lever 105 carried by frame 15; layer 105 is hinged in its middle portion to rotate in tilting manner around an axis C parallel to the winding axis of helical springs 16*b* and cooperates with one first end of its own with the rear part of latch 7 (FIG. 11) and with one second end of its own, opposite to the first end, with a contrast spring 106 carried by support 15. An appendix 107 of lever 106 cooperates, as a consequence of rotation of lever 106, with a pair of flexible foil springs 108, bringing them to contact against each other when pin 13 is in its end of stroke position in guides 14,17; foils 108 are connected with a male/female connector 109, of known type, which transmit accordingly the electric signal of closed door.

The invention claimed is:

1. A modular multipoint lock for installation into a door having a lock case recess located in a side edge of a door, a top recess extending from a top edge of the door adjacent the side edge of the door to the lock case recess, and a bottom recess extending from a bottom edge of the door adjacent the side edge of the door to the lock case recess, the modular multipoint lock comprising:

a first shootbolt assembly configured to be mounted in the top recess of the door, the first shootbolt assembly having a first engagement end housing configured to be located in the lock case recess when the first shootbolt assembly is installed in the top recess and a first shootbolt housing and a first shootbolt configured to be located adjacent the top of the door when the first shootbolt assembly is installed in the top recess and the first shootbolt housing is fastened to the door, the first engagement end housing of the first shootbolt assembly including a first end defining a slot, the first engagement end housing being drivingly connected to the first shootbolt by a first driverail of the first shootbolt assembly, the first drive rail being fixedly attached to the first engagement end housing;

a second shootbolt assembly configured to be mounted in the bottom recess, the second shootbolt assembly having a second engagement end housing configured to be located in the lock case recess when the second shootbolt assembly is installed in the bottom recess and a second shootbolt housing and a second shootbolt configured to be located adjacent the bottom of the door when the second shootbolt assembly is installed in the bottom recess and the second shootbolt housing is fastened to the door, the second engagement end housing of the second shootbolt assembly including a first end defining a slot, the first engagement end housing being drivingly connected to the second shootbolt by a second driverail of the second shootbolt assembly, the second drive rail being fixedly attached to the second engagement end housing;

a lock case having first and second drive arms extending therefrom, the first drive arm configured to extend into the slot defined in the first end of the first engagement end housing of the first shootbolt assembly to drivingly couple the first drive arm to the first engagement end housing and the second drive arm configured to extend into the slot defined in the first end of the second engagement end housing of the second shootbolt assembly to drivingly couple the second drive arm to the second engagement end housing when the lock case is inserted into the lock case recess, and the first and second drive arms configured to respectively disengage from the first and second engagement end housings of the first and second shootbolt assemblies when the lock case is removed from the lock case recess;

wherein the first drive arm is configured to slidingly engage into the slot defined in the first end of the first engagement end housing and the second drive arm is configured to slidingly engage into the slot defined in the first end of the second engagement end housing when the lock case is inserted into the lock case recess merely by the act of inserting the lock case into the lock case recess, and the first and second drive arms are configured to respectively slidingly disengage from the first and second engagement end housings of the first and second shootbolt assemblies when the lock case is removed from the lock case recess merely by the act of removing the lock case from the lock case recess.

2. A device according to claim 1, wherein and said receiving means consist of at least one seat carried, in use, by an edge of the door facing, in use, said side of the access opening provided with the supporting frame.

3. A device according to claim 1, wherein said first elastic means consist of at least one preloaded, tensioned helical spring restrained at the opposite ends thereof, on one side to said supporting frame, at said second axis and, on the opposite side, to a retraining point integral with the latch and arranged offset from the first axis and, with respect to the latter, on the opposite side with respect to the overhanging extension direction of said at least one locking tooth of the latch from the latch itself.

4. A device according to claim 3, wherein said helical spring ends with opposite hook-shaped ends, which are respectively coupled to: a first end of the supporting frame arranged in use so as to be distal from the door of the electric household appliance, in particular to a first pin forming said second axis, which first pin is transversally fastened to the first end of the supporting frame; and a second pin, parallel to the first, carried by the latch so as to be eccentric and parallel to a first axis within a recess of the latch open towards the first end of the supporting frame.

5. A device according to claim 1, wherein said latch is overhangingly provided with a radial appendix or arm extending, with respect to said first axis, from the same side of the fastening tooth, but in an direction diverging from the latter; said appendix being shaped so as to be adapted, in use, to cooperate in contact with an inner face of the door of the electric household appliance to stress the rotation of the latch against the bias of said first elastic means, from said second steady position towards the first steady position.

6. A device according to claim 5, wherein the rotation of said latch is guided between the first and second firm positions, about said first axis, by first cam means obtained on both opposite sides of the latch, radially protruding from said opposite pins forming the first axis, which first cam means are adapted to cooperate, during such a rotation, with second cam means obtained integral with the intermediate element laterally inside the same with respect to said first guides, on the side opposite to a frontal inlet opening thereof, designed to thoroughly receive said opposite pins of the latch.

7. A device according to claim 6, wherein said first cam means are defined by respective cylindrical sectors of a width substantially equal to a square angle, having a surface which is concentric with the first axis and obtained in one piece with the latch in a position diametrically opposite to the fastening tooth.

8. A device according to claim 1, wherein said intermediate element is shaped as a U-shaped frame consisting of a crosspiece arranged towards a first end of the supporting frame, to which it is rotationally restrained about said second axis, and by two reciprocally parallel arms which overhangingly protrude from the crosspiece towards a second open end of the supporting frame, opposite to the first end; said first guides consisting of through side grooves of the arms, frontally open towards the second end of the supporting frame.

9. A device according to claim 8, wherein said terminal L-shaped recesses of the second guides are adapted to receive in use said at least one protruding pin of the latch when this is substantially at the stroke end in the first guides.

10. A device according to claim 1, wherein it further comprises a micro switch arranged by the side of the supporting frame and cooperating with a cam element obtained in one piece with the latch, when the latter is in the first steady position with the door being closed.

11. A modular multipoint lock for installation into a door having a lock case recess located in a side edge of a door, a top recess extending from a top edge of the door adjacent the side edge of the door to the lock case recess, and a bottom recess extending from a bottom edge of the door adjacent the side edge of the door to the lock case recess, the modular multipoint lock comprising:

a first shootbolt assembly configured to be mounted in the top recess, the first shootbolt assembly having a first engagement end housing configured to be located in the lock case recess when the first shootbolt assembly is installed in the top recess and a first shootbolt housing and a first shootbolt located adjacent the top of the door when the first shootbolt assembly is installed in the top recess and the first shootbolt housing is fastened to the door, the first engagement end housing of the first shootbolt assembly being drivingly connected to the first shootbolt by a first driverail of the first shootbolt assembly, the first drive rail being fixedly attached to the first engagement end housing;

a second shootbolt assembly for mounting in the bottom recess, the second shootbolt assembly having a second engagement end housing that will be located in the lock recess when the second shootbolt assembly is installed in the bottom recess and a second shootbolt housing and a second shootbolt located adjacent the bottom of the door when the second shootbolt assembly is installed in the bottom recess and the second shootbolt housing is fastened to the door, the second engagement end housing of the second shootbolt assembly being drivingly connected to the second shootbolt, the second drive rail being fixedly attached to the second engagement end housing;

a lock case having first and second drive arms extending therefrom with each drive arm including a flange extending from the lock case, the first and second drive arms respectively engaging a slot defined in each of the first and second engagement end housings of the first and second shootbolt assemblies when the lock case is inserted into the lock case recess, and the first and second drive arms respectively disengaging from the slot the first and second engagement end housings of the first and second shootbolt assemblies when the lock case is removed from the lock case recess;

wherein the first drive arm is configured to slidingly engage into the slot defined in the first end of the first engagement end housing and the second drive arm is configured to slidingly engage into the slot defined in the first end of the second engagement end housing when the lock case is inserted into the lock case recess merely by the act of inserting the lock case into the lock case recess, and the first and second drive arms configured to respectively slidingly disengage from the first and second engagement end housings of the first and second shootbolt assemblies when the lock case is removed from the lock case recess merely by the act of removing the lock case from the lock case recess.

12. A device according to claim 1, wherein the at least one locking tooth is an integral portion of the latch.

13. A device according to claim 1, wherein the elastic means is linked to a first and second components such that a tension force is applied between the two components, the first component being located at the first axis, and the second component being located at the second axis.

14. A device according to claim 1, wherein the elastic means is linked to the one pin laterally protruding from the latch and a second component such that a tension force is applied between the one pin and the second component.

15. A device according to claim 1, wherein the elastic means includes opposite ends, which are respectively coupled to: a first end of the supporting frame arranged in use so as to be distal from the door of the electric household appliance, in particular to a first pin forming said second axis, which first pin is transversally fastened to the first end of the supporting frame; and a second pin, parallel to the first, carried by the latch so as to be eccentric and parallel to a first axis within a recess of the latch open towards the first end of the supporting frame.

16. An electric household appliance comprising a casing delimiting an access opening of a washing chamber or tank and a closing door of said access opening, which is delimited at the top by a U-shaped crosspiece of the casing having the concavity facing the opposite side of an upper edge of the door; wherein it comprises a door locking device according to claim 1, wherein said supporting frame with the latch is accommodated within said crosspiece, in a position facing an opening thereof adapted to thoroughly receive the locking tooth of the latch; and wherein the receiving means for the locking tooth are carried by a plate element fixed to said upper edge of the door, in a position facing said opening of the crosspiece, with the door being closed.

* * * * *